United States Patent [19]

Kawashima et al.

[11] Patent Number: 5,062,279

[45] Date of Patent: Nov. 5, 1991

[54] ARTIFICIAL SNOWFALL SYSTEM

[75] Inventors: Ichiro Kawashima, Tokyo; Mitsuo Seki, Atsugi; Isao Hirano, Toda, all of Japan

[73] Assignees: Kabushikigaisha Toyo Seisakusho, Tokyo; Marubeni Kabushikigaisha, Osaka, both of Japan

[21] Appl. No.: 649,989

[22] Filed: Feb. 4, 1991

[30] Foreign Application Priority Data

Feb. 9, 1990 [JP] Japan ..... 2-30540

[51] Int. Cl.[5] ..... A63C 19/10

[52] U.S. Cl. ..... 62/235; 62/388; 239/14.2

[58] Field of Search ..... 239/14.2; 62/235, 354, 62/388

[56] References Cited

U.S. PATENT DOCUMENTS 4,640,460 2/1987 Franklin, Jr. ..... 239/14.2 X
4,726,195 2/1988 Klee ..... 62/388 X
4,742,958 5/1988 Bucceri ..... 239/14.2 X
4,761,969 8/1988 Moe ..... 62/388
4,809,514 3/1989 Suga et al. ..... 239/14.2 X
4,891,954 1/1990 Thomsen ..... 62/388 X

*Primary Examiner*—Lloyd L. King

[57] ABSTRACT

An artificial snowfall system comprises a snowfall room (2) in which are properly disposed a snow catching element (4) made of materials excellent in gas permeability and an atomizer unit (8) for ejecting atomized particles of liquid into the room (2). The atomized particles are frozen by heat exchange with ambient air within the room (2). The ambient air is kept at a temperature of below a freezing point of the liquid and forms an air flow passing through the snow catching element (4). The air flow causes the frozen particles to be deposited on one side of the catching element (4) to form a snow layer thereon. A beater element (9) for beating the other side of the catching element (4) is oppositely disposed from the other side to have the snow layer separated from the catching element (4). The thus separated snow layer creates artificial snowfall in the room (2).

6 Claims, 6 Drawing Sheets

ARTIFICIAL SNOWFALL SYSTEM

1. Field of the Invention

The present invention relates generally to snow making machines, and more particularly to an artificial snowfall system which can create artificial snowfall in more natural conditions even inside the large volume rooms of buildings.

2. Description of the Prior Art

Although many types of indoor artificial snowfall systems have been developed, all of the conventional systems are poor in effective snowfall area and in volume of snow per unit time, and therefore cannot create heavy snowfall conditions.

SUMMARY OF THE INVENTION

It is an object of the present invention to provide an artificial snowfall system which can create artificial snowfall in more natural conditions, even inside the very large volume rooms of buildings such as gymnasium buildings, wherein the artificial snowfall is properly controlled in volume of snow per unit time, in the properties of the snow and in the falling velocity of the snow so as to produce more natural snowfall conditions, such as heavy snowfall conditions.

The above object of the present invention is accomplished by providing:

An artificial snowfall system comprisingn:

- a snowfall room;
- a snow catching element properly disposed in the snowfall room, the snow catching element being made of materials excellent in gas permeability;
- an atomizer unit for ejecting atomizer particles of liquid into the snowfall room, the atomized unit being properly disposed in the snowfall room;
- ambient air within the snowfall room, which ambient air is kept at a temperature below the freezing point of the liquid, and which forms an air flow passing through the snow catching element to thereby cause the atomized particles to be frozen by heat exchange with the ambient air and also to cause the atomized particles having been frozen to be deposited on one side of the snow catching element so as to form a snow layer thereon; and
- a beater element for beating the other side of the snow catching element, the beater element being oppositely disposed from the other side of the snow catching element to cause the snow layer to be separated from the other side of the snow catching element in flake-like state during beating operation thereof;
- whereby the snow layer having been separated from the other side of the snow catching element creates artificial snowfall in the snowfall room.

Embodiments of the present invention will be described with reference to the accompanying drawings in which:

DESCRIPTION OF THE PREFERRED EMBODIMENTS

Figure 1:
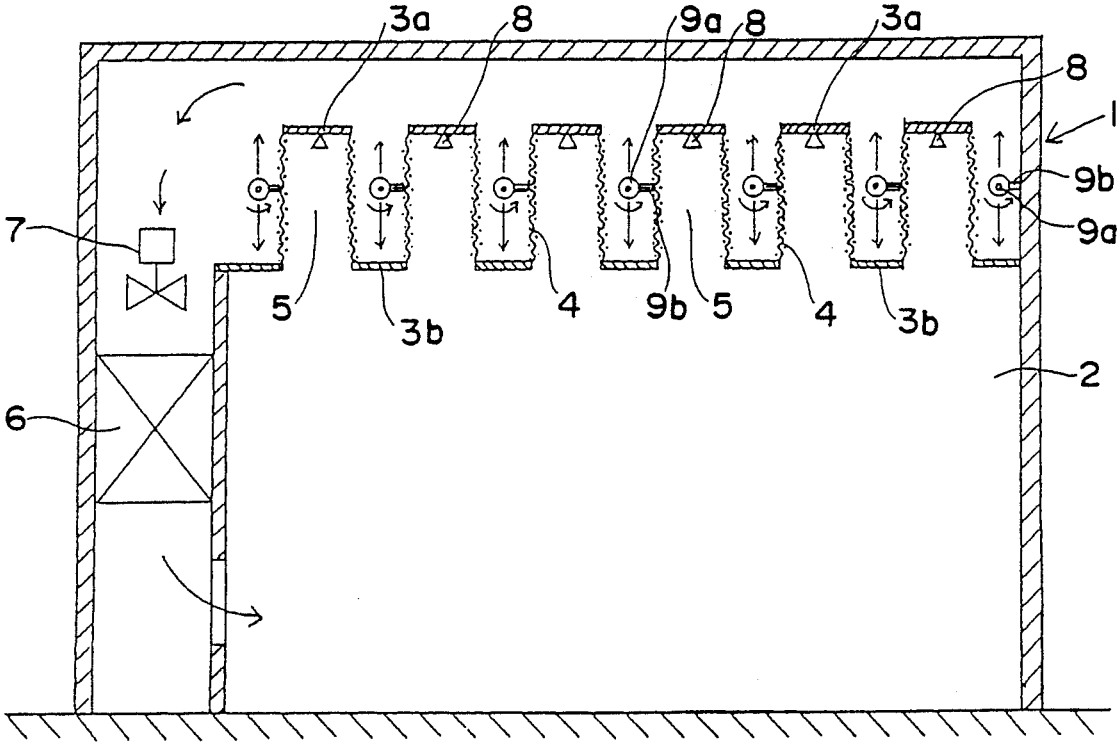
FIG. 1 is a longitudinal sectional view of a first embodiment of the artificial snowfall system of the present invention.

The embodiments of the present invention will be described in detail hereinbelow with reference to the drawings.

FIGS. 1 to 4 show a first embodiment of the artificial snowfall system of the present invention, in which the reference numeral 1 denotes a building of the artificial snowfall system of the present invention.

A snowfall room 2 is formed in the building 1. In the snowfall room 2, a plurality of upper retaining plates 3*a* are fixedly mounted below a ceiling portion of the snowfall room 2 so as to be spaced apart from each other in a longitudinal direction of the snowfall room 2 as shown in FIG. 1 and so as to extend in a width direction of the snowfall room 2 as shown in FIG. 2.

Opposite side-end portions of each of the upper retaining plates 3*a* are connected with upper-end portions of the snow catching elements 4. On the other hand, lower-end portions of the snow catching elements 4 are connected with opposite side-end portions of each of the lower retaining plates 3*b* which are disposed below the upper retaining plates 3*a* in the snowfall room 2 so as to be staggered along the upper retaining plates 3*a*. Therefore, the lower retaining plates 3*b* are also spaced apart from each other in the longitudinal direction of the snowfall room 3, and also extend in the width direction of the snowfall room 2 in parallel to the upper retaining plates 3*a*. As a result, as is clear from FIG. 1, the snow catching elements 4 are interposed between the upper retaining plates 3*a* and the lower retaining plates 3*b* to extend substantially vertically therebetween. Each of the snow catching elements 4 is made of a material excellent in air permeability, for example such as cloth, nylon, net or similar synthetic resin net materials.

Figure 2:
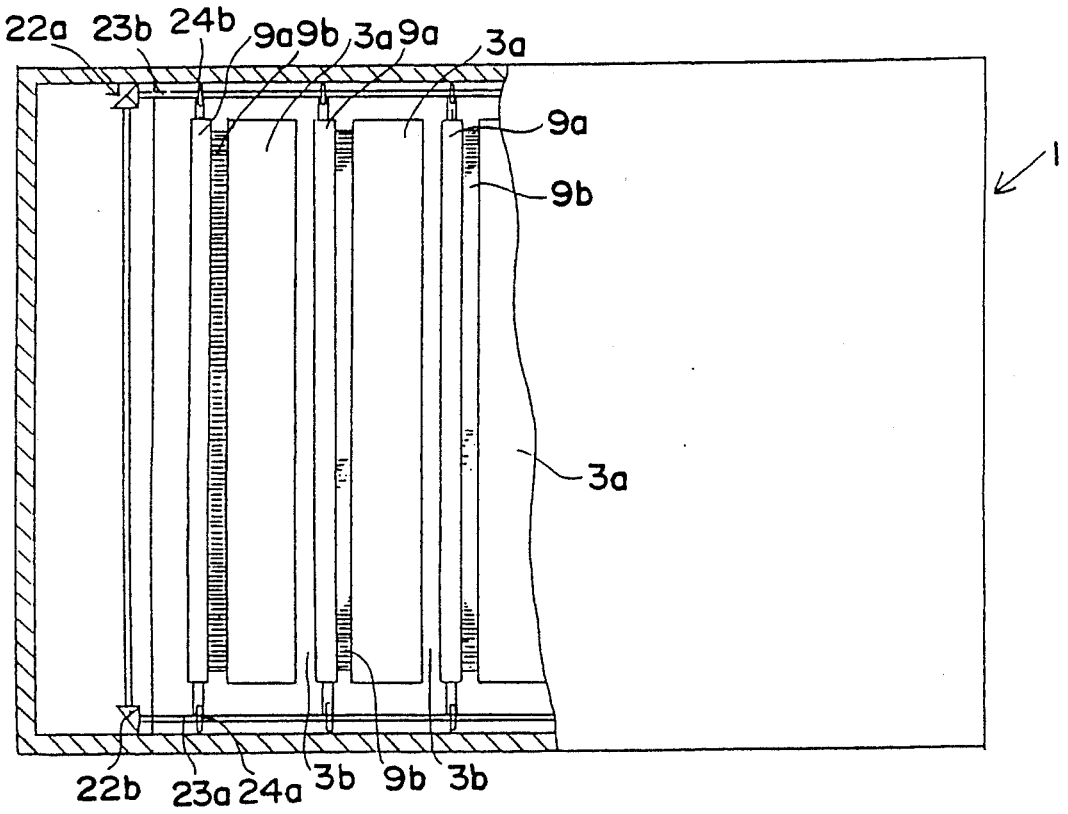
FIG. 2 is a partially broken plan view of the first embodiment shown in FIG. 1.

As shown in FIG. 1, cooling air which has been cooled by a refrigerating unit 6 to a temperature of below the freezing point of a liquid such as water to be frozen, is blown into the lower space of the snowfall room 2, and moved upward to enter a snow-generating chamber 5 which is defined by the snow catching elements 4. A plurality of the snow-generating chambers 5 are provided in the snowfall room 2. The cooling air then passes through the snow catching elements 4 to reach a circulating blower 7 which is used to bring the cooling air back to the lower space of the snowfall room 2 through the refrigerating unit 6, thereby permitting the cooling air to be repeatedly cooled by the refrigerating unit 6 and circulated by the blower 7 within the building 1.

An atomizer unit 8 for ejecting atomized particles of the liquid such as water into the snowfall room 2 is properly disposed in each of the snow-generating chambers 5. The atomizer unit 8 is constructed of two-fluid atomizing nozzles which atomize the liquid (such as water) by the use of compressed air. It is also possible to provide ultrasonic humidifiers (not shown) in each of the snow-generating chambers 5, if necessary.

In the artificial snowfall system of the present invention having the above construction, the atomized particles of liquid (such as water) having been ejected into the snow-generating chambers 5 from the atomizer units 8, are cooled by heat exchange with the cooling air flowing upward in the snow-generating chambers 5. The cooling air then passes through the snow catching elements 4. The atomized particles thus cooled become frozen, and are deposited on inner surfaces of the snow catching elements 4 to form snow layers thereon under the influence of the cooling air flowing upward and passing through the snow catching elements 4 in the snow-generating chambers 5.

Figure 3:
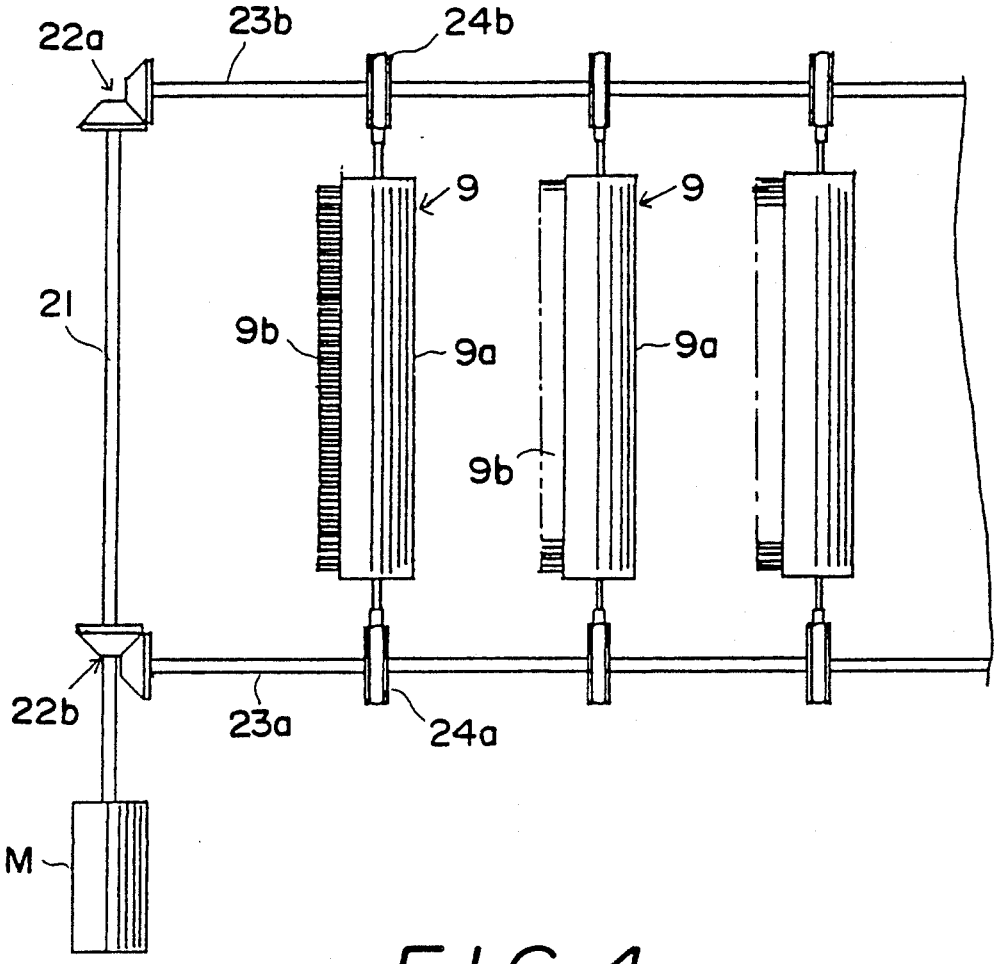
FIG. 3 is a plan view of a drive mechanism for rotatably driving rotary beater elements employed in the first embodiment shown in FIG. 1.

In FIG. 3, the reference numeral 9 denotes a beater element which beats the outer surfaces of the snow catching elements 4 to have the snow layers separated from the inner surfaces of the snow catching elements 4. During its beating operation, the beater element 9 is moved up and down in parallel to the outer surfaces of the snow catching elements 4.

As shown in FIGS. 1 to 4 a first embodiment of the beater element 9 is constructed of a rotary beater element **9*a* which is rotatably driven on its axis extending in parallel to the width direction of the snowfall room 2. The rotary beater element 9*a* is partially provided with an implanted brush member 9*b* in its outer peripheral surface. During its beating operation, the implanted brush member 9*b* of the rotary beater element 9*a* beats the outer surfaces of the snow catching elements 4 as the rotary beater element 9*a* is moved up and down in parallel to the outer surfaces of the snow catching elements 4**, on which outer surfaces the snow layers have been deposited.

Figure 4:
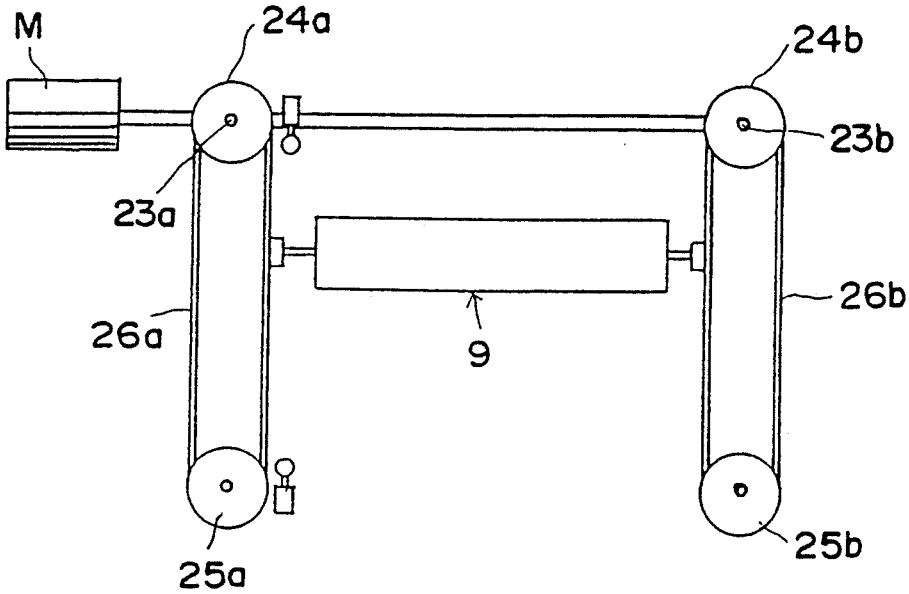
FIG. 4 is a side view of the drive mechanism shown in FIG. 3.

FIGS. 3 and 4 show an embodiment of a drive mechanism for rotatably driving beater element 9 and for moving the same up and down in parallel to the other surfaces of the snow catching elements 4. It is possible to modify this embodiment in various ways. In FIG. 3, the reference numeral 21 denotes a drive shaft which is rotatably driven by a motor M. The drive shaft 21 extends parallel to the width direction of the snowfall room 2, and is meshed with an upper drive shaft **23*b* through a pair of bevel gears 22*a* at its free end, and also meshed with another upper drive shaft 23*a* through another pair of bevel gears 22*b* in the vicinity of the motor M. These upper drive shafts 23*a*, 23*b* are parallel and spaced apart from each other to extend in parallel to the longitudinal direction of the snowfall room 2. A plurality of upper sprockets 24*a* are fixedly mounted on the upper drive shaft 23*a*, while parallel and spaced apart from each other at the same intervals as those of the rotary beater elements 9*a*. On the other hand, a plurality of upper sprockets 24*b* are also fixedly mounted on the upper drive shaft 23*b*, while parallel and spaced apart from each other at the same intervals as those of the rotary beater elements 9*a***.

As shown in FIG. 4, the upper sprockets **24*a* and 24*b* are vertically spaced apart from lower sprockets 25*a* and 25*b*, respectively. As a result, a plurality of vertical pairs of sprockets 24*a*, 25*a* are formed together with a plurality of vertical pairs of the sprockets 24*b*, 25*b*. An endless chain 26*a* runs round each of the vertical pairs of the sprockets 24*a*, 25*a*. On the other hand, another endless chain 26*b* runs round each of the vertical pairs of the sprockets 24*b*, 25*b***.

The rotary beater element **9*a* may include a motor roller 9, a drive shaft of which has its opposite ends connected with the endless chains 26*a*, 26*b* through suitable joint means in a condition in which the drive shaft extends in parallel to the width direction of the snowfall room 2. The motor roller 9 is provided with a cylindrical housing which constitutes a rotary member partially provided with the implanted brush member 9*b*. In beating operating, since the opposite ends of the drive shaft of the motor roller 9 are connected with the endless chains 26*a* and 26*b*, the cylindrical housing of the motor roller 9 is rotatably driven so that the implanted brush member 9*b* provided in the cylindrical housing of the motor roller 9** is also rotatably driven.

Under such circumstances, the motor M rotates in forward and reverse directions to cause the endless chains **26*a* and 26*b* to run in forward and reverse directions so that the motor rollers or beater elements 9 are moved up and down in parallel to the outer surfaces of the snow catching elements 4. In the first embodiment of the artificial snowfall system described above with reference to FIGS. 1 to 4, the snow layers are formed on the inner surfaces of the snow catching elements 4, the outer surfaces of which are beaten with the beater elements 9 so that the snow layers are separated from the outer surfaces of the snow catching elements 4 in flake-like state to thereby create artificial snowfall in more natural conditions in the snowfall room 2**.

Figure 5:
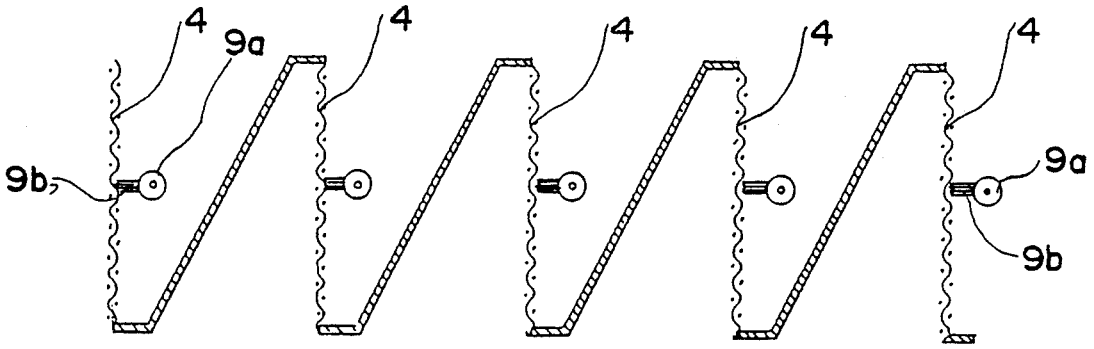
FIG. 5 is another embodiment of the snow catching element employed in the first embodiment of the artificial snowfall system shown in FIG. 1.

The snow catching element 4 may be modified to have a construction as shown in FIG. 5. Although such modification is not described herein in detail to avoid a redundant description, it is clear that various modifications of the snow catching elements 4 are possible.

Figure 6:
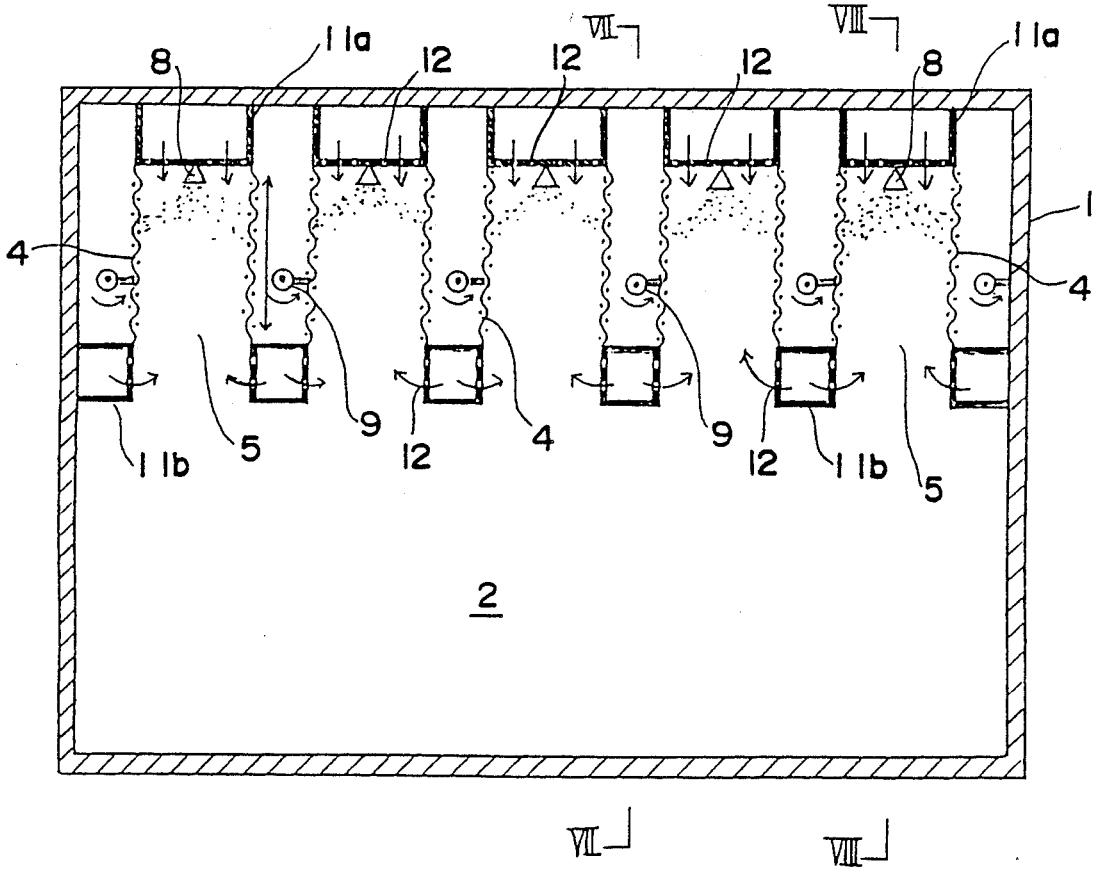
FIG. 6 is a second embodiment of the artificial snowfall system.
Figure 7:
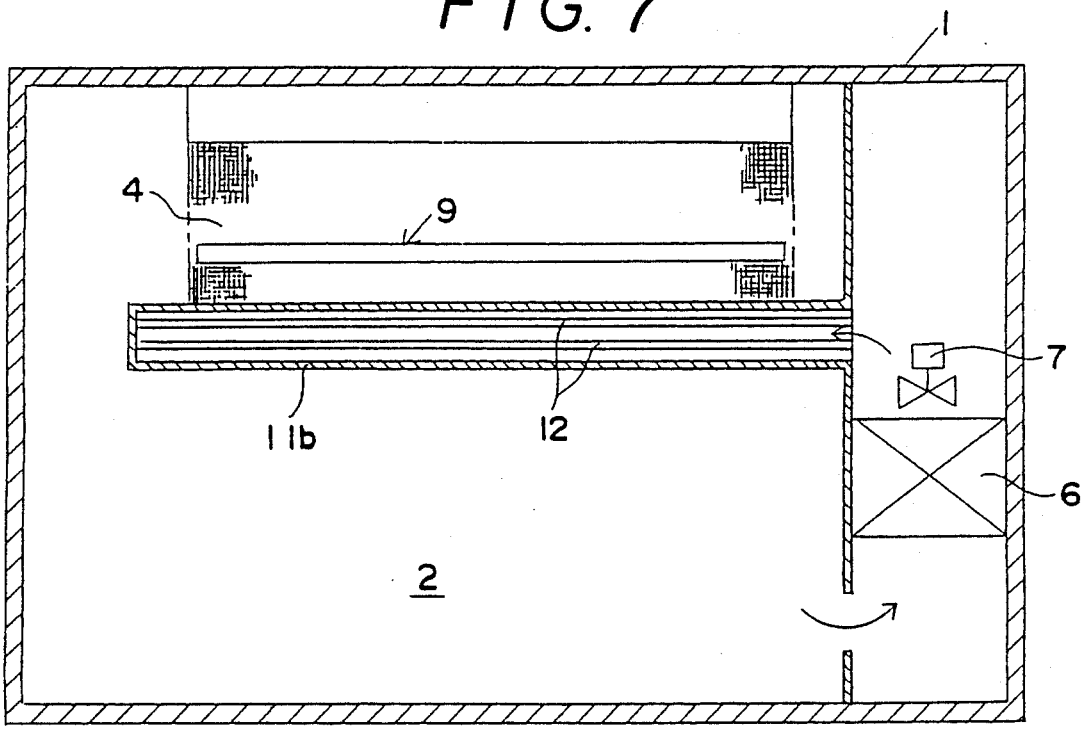
FIG. 7 is a cross-sectional view of the second embodiment of the artificial snowfall system shown in FIG. 6, taken along the line VII—VII of FIG. 6.
Figure 8:
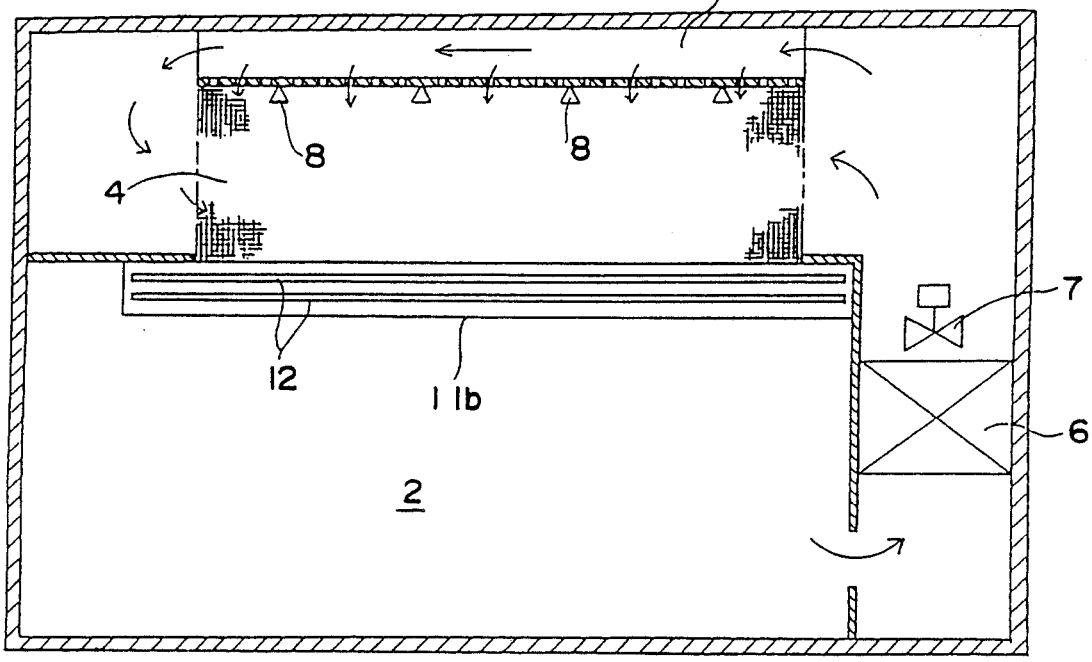
FIG. 8 is a cross-sectional view of the second embodiment of the artificial snowfall system shown in FIG. 6, taken along the line VIII—VIII of FIG. 6.
Figure 9:
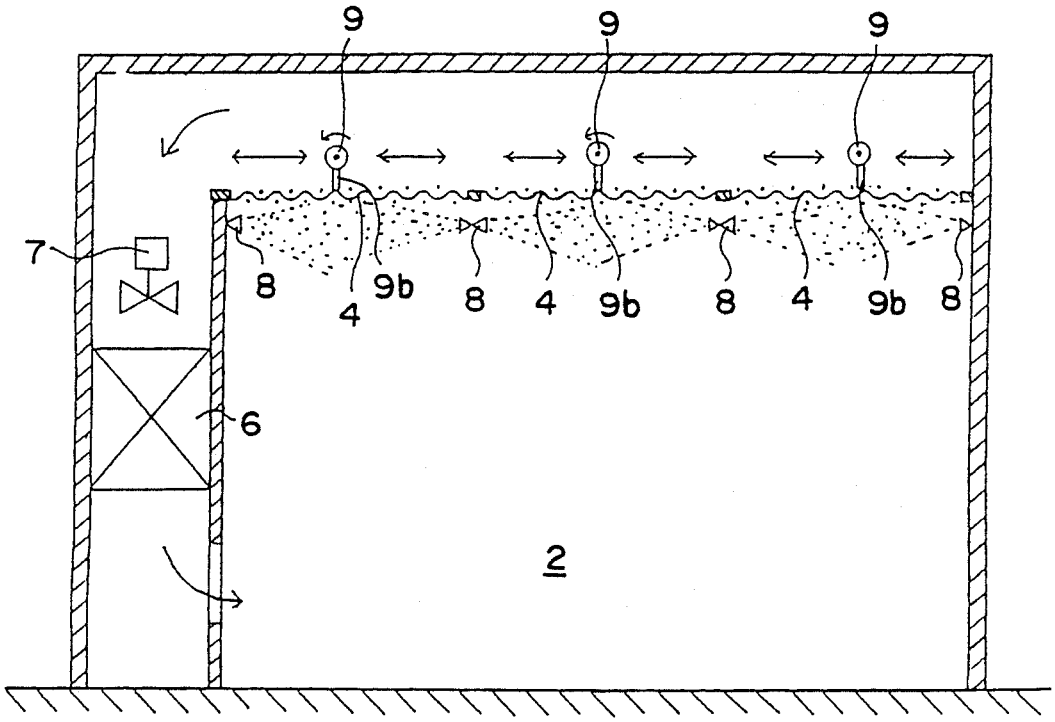
FIG. 9 is a third embodiment of the artificial snowfall system.
Figure 10:
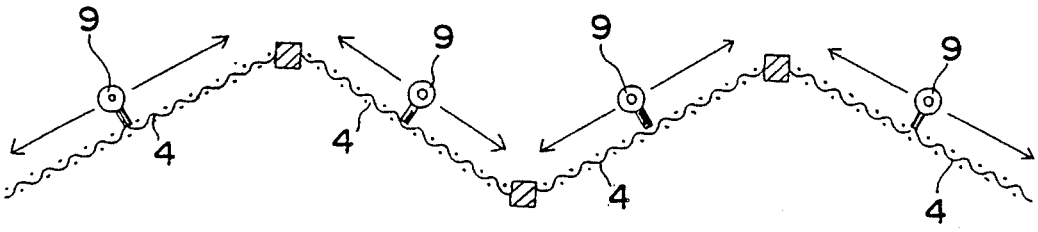
FIG. 10 is another embodiment of the snow catching element employed in the third embodiment of the artificial snowfall system shown in FIG. 9.
Figure 11:
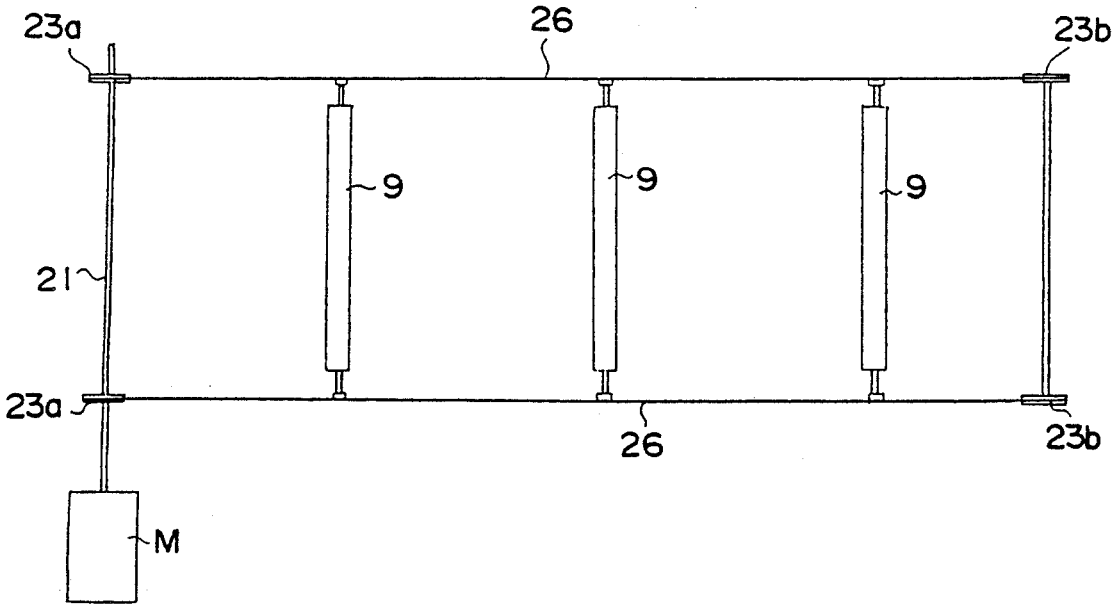
FIG. 11 is a plan view of the beater elements employed in the third embodiment of the artificial snowfall system shown in FIG. 9.
Figure 12:
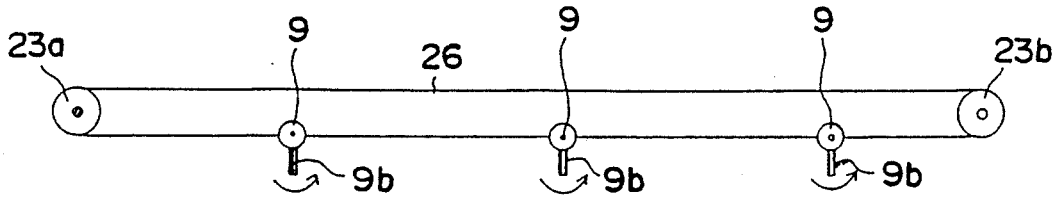
FIG. 12 is a front view of the beater elements shown in FIG. 11.

FIGS. 6 to 8 show a second embodiment of the artificial snowfall system of the present invention. In this second embodiment, the upper retaining plates **3*a* and the lower retaining plates 3*b* of the first embodiment shown in FIGS. 1 to 5 are substituted with upper ducts 11*a* and lower ducts 11*b*, respectively and the each duct has the air injection ports 12. In the second embodiment the cooling air is supplied to the snow-generating chambers 5 through both of the upper ducts 11*a* and the lower ducts 11*b*. On the other hand, as shown in FIG. 6 the atomizer unit 8 is mounted on a lower surface of each of the upper ducts 11*a***.

In the second embodiment of the artificial snowfall system of the present invention, there is no possibility of a large snow block drops from the snow-generating chambers 5. In contrast with this, in the first embodiment of the artificial snowfall system shown in FIGS. 1 to 5, there is a possibility that the snow layers formed on lower surfaces of the upper retaining plates **3*a* in the snow-generating chambers 5 to grow into large snow blocks which eventually drop from the snow-generating chambers 5** under the influence of gravity.

In the second embodiment of the artificial snowfall system shown in FIGS. 6 to 8, since the upper duct 11*a* is provided with a plurality of air injection ports 12 in its lower surface, and is provided in an upper area of each of the snow-generating chambers 5 in place of each of the upper retaining plates 3*a*, there is substantially no possibility that the snow layers are formed on the lower surfaces of the upper ducts 11*a*, and therefore there is substantially no possibility that the large snow blocks drop from the snow-generating chambers 5 of the second embodiment of the artificial snowfall system.

FIGS. 9 to 12 show a third embodiment of the artificial snowfall system in which third embodiment each of the snow catching elements 4 employed in the first and the second embodiment is substituted with a horizontal snow catching element 4 lying in a plane parallel to the floor of the snowfall room 2. In the third embodiment the atomizer units 8 are disposed below the snow catching elements 4 in the snowfall room 2 to cause the snow layers to be formed on lower surfaces of the snow catching elements 4. On the other hand, in beating operation the rotary beater elements 9 are moved back and forth in a horizontal plane to beat upper surfaces of the snow catching elements 4.

In the third embodiment, the atomized particles of the water, having been ejected from the atomizer units 8, are then frozen in the snowfall room 2 by heat exchange with the cooling air which flows upward to pass through the snow catching elements 4, so that the atomized particles thus frozen are deposited on the lower surfaces of the snow catching elements 4 to form the snow layers thereon under the influence of the cooling air flowing upward in the snowfall room 2.

During the beating operation, the upper surfaces of the snow catching elements 4 are sequentially beaten with the implanted brush members 9*b* of the rotary beater elements 9 to cause the snow layers formed on the lower surfaces of the snow catching elements 4 to be separated therefrom in flake-like state, thereby permitting such separated flake-like snow layers to create artificial snowfall in the snowfall room 2 in more natural conditions.

In accordance with the present invention, the snow layers formed on the snow catching elements 4 are not scratched off, but beaten through the snow catching elements 4 so as to be separated therefrom in flake-like state before the snow layers become too thick. Consequently, it is possible for the artificial snowfall system of the present invention to create artificial snowfall in more natural conditions. As a result, the artificial snowfall system of the present invention may create an artificial snowfall excellent in properties in contrast with the conventional indoor artificial snowfall systems.

In addition, it is possible for the artificial snowfall system of the present invention to create a heavy snowfall in more natural conditions by increasing the volume of snow per unit time, which is realized by increasing the number of the snow catching elements 4 having vertical constructions such as those employed in the first and the second embodiments of the present invention.

We claim:

1. An artificial snowfall system comprising:

a snowfall room;

a snow catching element disposed in said snowfall room, said snow catching element being made of an air-permeable material;

an atomizer unit for ejecting atomized particles of liquid into said snowfall room, said atomizer unit being disposed in said snowfall room;

ambient air within said snowfall room, in operation of the system, being kept at a temperature below freezing point of said liquid, and forming an air flow passing through said snow catching element to cause said atomized particles to be frozen by heat exchange with said ambient air and also to cause said atomized and frozen particles to be deposited on one side of said snow catching element so as to form a snow layer thereon; and a beater element for beating the other side of said snow catching element, said beater element being oppositely disposed from said one side of said snow catching element to cause said snow layer to be separated from said one side of said snow catching element in a flake-like state during the beating operation thereof;

whereby said snow layer when separated from said one side of said snow catching element creates artificial snowfall in said snowfall room.

2. The artificial snowfall system as claimed in claim 1 wherein; said beater element is operable to travel along a surface of said snow catching element in a reciprocating manner, while said beater element beats said snow catching element.

3. The artificial snowfall system as claimed in claim 1 wherein; a plurality of said snow catching elements are arranged in lateral or horizontal rows in an upper portion of said snowfall room.

4. An artificial snowfall system comprising:

a plurality of upper retaining plates which are disposed generally horizontally in an upper portion of a snowfall room while spaced apart from each other at predetermined intervals so as to be arranged generally parallel to each other, said snowfall room having in operation, cooling air circulating therethrough and having kept at a temperature below the freezing point of a liquid;

a plurality of lower retaining plates which are disposed generally horizontally in said upper portion of said snowfall room while spaced apart from each other at the same predetermined intervals as those of said upper retaining plates so as to be arranged generally parallel to each other, said lower retaining plates being disposed below said upper retaining plates so as to be staggered along said upper retaining plates;

a plurality of snow-generating chambers each of which includes an upper retaining plate; and a snow catching element made of a gas-permeable material, said snow catching element having its upper portion fixedly mounted on opposite ends of said upper retaining plate and having its lower portion fixedly mounted on opposite ends of said lower retaining plates;

an atomizer unit for ejecting atomized particles of said liquid into each of said snow-generating chambers, said atomizer unit being so arranged in each of said snow-generating chambers that said atomized particles of said liquid are frozen by heat exchange with said cooling air so as to produce frozen particles of said liquid which are deposited on an inner surface of said snow catching element to form a snow layer; and a beater element for beating an outer surface of said snow catching element to separate said snow layer from said inner surface of said snow catching element;

whereby said snow layer when separated from said inner surface of said snow catching element, creates artificial snowfall in said snowfall room.

5. An artificial snowfall system comprising:

a snowfall room;

a plurality of upper ducts to which is delivered cooling air a temperature which is below the freezing point of ? , said upper ducts being provided in an upper portion of said snowfall room while spaced apart from each other at predetermined intervals so as to be arranged in a plurality of rows which are generally parallel to each other, each of said upper ducts being provided with an upper blowout hole in its lower portion;

a plurality of lower ducts to which is also delivered said cooling air, said lower ducts being disposed below said upper ducts in said snowfall room so as to be staggered along said upper ducts and generally parallel thereto, each of said lower ducts being provided with a lower blowout hole in each of its opposite side portions;

a plurality of snow catching elements each of which is made of materials excellent in gas-permeable material and has its upper portion fixedly mounted on opposite side portions of each of said upper ducts and has its lower portion fixedly mounted on upper parts of opposite side portions of each of said lower ducts;

a plurality of snow-generating chambers each of which includes an upper duct and a lower duct together with said snow catching element, and has its lower portion opening into said snowfall room;

an atomizer unit for ejecting atomized particles of said liquid into each of said snow-generating chambers, said atomizer unit being such that in each of said snow-generating chambers to said atomized particles of sid liquid are frozen by heat exchange with said cooling air so as to produce frozen particles of said liquid which are deposited on an inner surface of said snow catching element to form a snow layer; and a beater element for beating an outer surface of said snow catching element to separate said snow layer from said inner surface of said snow catching element;

whereby said snow layer when separated from said inner surface of said snow catching element, creates artificial snowfall in said snowfall room.

6. The artificial snowfall system as claimed in claim 4 or 5, wherein; said beater element is operable to travel along a surface of said snow catching element in a reciprocating manner, while said beater element beats said snow catching element.

* * * * *